United States Patent [19]

Gerritsen

[11] Patent Number: 4,592,180

[45] Date of Patent: Jun. 3, 1986

[54] MAGNET SUPPORT AND RETAINER FOR INTERIOR STORM WINDOWS

[75] Inventor: John T. Gerritsen, Wauconda, Ill.

[73] Assignee: Jarrow Products, Inc., Chicago, Ill.

[21] Appl. No.: 591,037

[22] Filed: Mar. 19, 1984

[51] Int. Cl.[4] ..... E06B 3/28

[52] U.S. Cl. ..... 52/203; 49/62; 49/478; 52/DIG. 4

[58] Field of Search ..... 52/202, 203, DIG. 4; 49/62, 478

[56] References Cited

U.S. PATENT DOCUMENTS

| | | | |
|---|---|---|---|
| 3,075,258 | 1/1963 | Petkwitz | 49/478 |
| 3,241,198 | 3/1966 | Baermann | 49/478 |
| 3,376,615 | 4/1968 | Hickman | 52/DIG. 4 |
| 3,869,873 | 3/1975 | Thomas | 49/478 |
| 4,079,558 | 3/1978 | Gorham | 49/478 |
| 4,184,297 | 1/1980 | Casamayor | 52/202 |

*Primary Examiner*—Billy S. Taylor

*Attorney, Agent, or Firm*—Silverman, Cass & Singer

[57] ABSTRACT

A magnet support and retainer for post-construction installed interior storm windows formed as a unitary plastic extrusion having a U-shaped pane-receiving portion, a rigid magnet mounting portion and a connecting portion, preferably flexible, formed therebetween. The magnet mounting portion includes an elongate rigid planar strip having a pair of depending edge flanges defining a cavity for tightly receiving a strip magnet of generally rectangular cross-section and an intermediate depending flange including barb portions adapted to be received tightly within a facing groove formed in the magnet. The opposite magnet face is engaged upon a ferromagnetic strip or sash surface for installation of the storm window. Resilience is afforded sufficient to compensate for irregularities in the pane or in the cooperating ferromagnetic surface when the storm window is installed. The magnet is force fitted in the cavity enabling easy assembly.

12 Claims, 3 Drawing Figures

MAGNET SUPPORT AND RETAINER FOR INTERIOR STORM WINDOWS

BACKGROUND OF THE INVENTION

This invention relates generally to postconstruction installed interior storm windows of the type magnetically supported over a window installation for reducing heat loss. More particularly, an improved magnet mounting and retainer is provided having a construction enabling facile mounting of the magnet and the storm windowpane and providing sufficient resilience to compensate for variations in the overall thickness and surface of the pane and/or the window framing surface on which the storm window is adhered magnetically whereby to assure a sealed relationship.

Storm windows conventionally are employed to permit entry of light while creating a dead air space to reduce heat transmission during the winter, as well as to reduce cooling loss during summer. Initially, storm windows were seasonally installed, being dismounted in Spring and remounted in the Fall. This routine has been replaced by the use of combination windows which are permanently installed, serving both as storm windows and screens. Such combination windows are produced generally in standardized dimensions while many window openings may not be dimensioned to accommodate the available standardized structures. Additionally, the installation may not perform the sealing function to produce a truly dead air space with some leakage present to reduce the efficiency of the arrangement.

In response to the need for improving efficiency while providing a simply installed, inexpensive, convenient arrangement, as shown in U.S. Pat. No. 4,079,558, a storm window attachable on a window frame over the face of a window by magnetic means was developed. A sheet of glass or plastic was provided with a frame of permanent magnets secured about the periphery of one surface. Strips of ferromagnetic material were secured to the face of the window frame. The magnetically framed window was held by the ferromagnetic strips resiliently and removably. The sheet material was suitable for use over large picture windows where available storm windows were not constructed in suitable dimensions.

Difficulties were encountered in providing suitable mounting means for supporting the permanent magnets on the sheet material. The sheets were manufactured with edge nonuniformities, variations in thickness, encountering slippage, ripples along the edges and other nonuniformities which made difficult obtaining of a consistent secure sealed coupling between the magnet frame and the magnetic mounting strip. Differences in expansion characteristices of material at varied temperatures also cause bowing and varied expansion characteristics. Slippage of the frame parts relative to the sheet material was experienced.

The conventional framing processes included the extrusion of the rigid plastic polymer from a die so that the structure includes an outer portion within which the sheet is mounted, an inner closed pocket for containing a strip magnet slidably inserted therein and an intermediate portion formed as a flexible hollow, resilient pair of connecting walls functioning as a bellow formation. The outer portion is formed as an extruded rigid plastic in a generally U-shaped configuration having legs spaced apart to spring convergently toward their outer ends. The plastic material is sufficiently resilient that a sheet or pane of transparent plastic as thick as the inside width of the U at its closed end is inserted into the open end of the U, the legs spread sufficiently to accommodate the pane firmly to grip the same. Small inwardly directed angular fingers of lesser durometer hardness can be provided integral with the legs of the U and extending interiorly therebetween to accentuate the grip.

The frame portions are usually mitered at their corners so that the flat surfaces define a single plane for cooperating with the plane defined by magnetic or ferromagnetic strips on the sash frame. In prior constructions, considerable difficulty has been encountered in establishing adequate magnetic purchase on the pane as well as on the ferromagnetic strips due to nonuniformity of surface contour, both of the sash frame as well as of the pane itself.

Another factor of disadvantage in prior constructions of this type involves the difficulty of assembly encountered in inserting the magnetic strip into the retaining pocket or sheath provided. Normally the sheath is formed of flexible extruded looped material of loop configuration having open ends into which the magnet element is slidably inserted. Most efficient operation occurs when the magnet element is securely sheathed within the magnet retainer. Under normal circumstances it is difficult to slide the magnet element into the open end of the retainer if the loop is formed of an inner crosssection closely fitted to receive the magnet element tightly sheathed so that there is minimum relative movement of the two elements.

The invention contemplates providing a rigid retainer for the magnet element which holds the magnet securely yet possesses sufficient resilience to enable the magnet to conform to variations in the surface topography of both pane and the support surface of the ferromagnetic strips to which the magnet strip causes adherence. Further, as contemplated by the herein invention, the magnet element is mounted for self-adjustment establishing excellent adherence. The magnetic element desirably is held securely and is capable of being mounted to the retainer strip quickly and effectively. The assembly according to the invention is extruded of two durometer material, the pane retainer and magnet retainer having rigidity for supporting the receptor material while including sufficiently flexible means for gripping the received element, as well as providing a satisfactory flexibility and enabling installation and maintenance of a sufficiently sealed installation establishing a true dead air space between storm window and preexisting windowpanes.

SUMMARY OF THE INVENTION

A magnet support and retainer for post construction installed storm windows of the type magnetically supported over the interior face of a preexisting window installation, said magnet support and retainer comprising a unitary extrusion having a U-shaped, rigid pane-receiving portion, a generally rigid magnet retaining strip portion and a connecting portion therebetween, said retaining strip portion having a pair of coextensive depending edge flanges defining a cavity for receiving a magnetic body force fitted therein and a depending tongue formation adapted to be engaged within a groove formation in the magnetic body when same is received within said cavity. Resilient barbs are provided on said tongue formation. Tooth means may be provided within the groove formation for cooperation with the resilient barbs provided on the tongue formation for resiliently retaining same therein. Preferably, the connecting portion is flexible to serve thereby additionally for compensation purposes.

DESCRIPTION OF PREFERRED EMBODIMENTS

The magnet mounting and retainer according to the invention to be described hereinafter is formed as an elongate unitary extrusion preferably formed of polyvinyl chloride, select portions being of lesser durometer than other portions. The extrusion includes a rigid U-shaped portion for receiving and retaining the windowpane, a rigid planar portion having coextensive depending edge flanges defining a channel or cavity for receiving a permanent magnet force-fitted therein and a connecting portion, preferably of lesser durometer material to define a bellows-like resilient connection between the rigid portions. The magnet body has a longitudinal groove formed therein opening to one face thereof and a uniform planar opposite face. The rigid planar portion is provided with a depending tongue formation extending into the cavity and adapted to be tightly engaged within the groove of the magnet body. Teeth may be formed within the groove for cooperation with flexible barbs formed on the tongue formation to provide a resilience to compensate for irregularities in the window sash surface of irregularities caused by variations in the surface of the thickness of the pane which is received within the U-shaped portion. Fingers may be provided within the U-shaped pane-receiving portion for cooperation with the surface of the pane for retention supplementing the frictional engagement of the pane therein. The retainer preferably extends the length of each side of the pane and may be mitered for mating purposes at opposite ends thereof.

The capability of the retainer according to the invention ro receive the magnet body force fitted therein eliminates the problems encountered in mounting the magnet bodies by threading same endwise through the pocket formations generally provided by the prior art to receive same. The planar face of the magnet is disposed properly to be engaged directly on the window sash, if the latter is formed of ferromagnetic material, or upon flat strips of ferromagnetic material which are applied to nonmagnetic sash materials such as formed of wood or aluminum.

Figure 1:
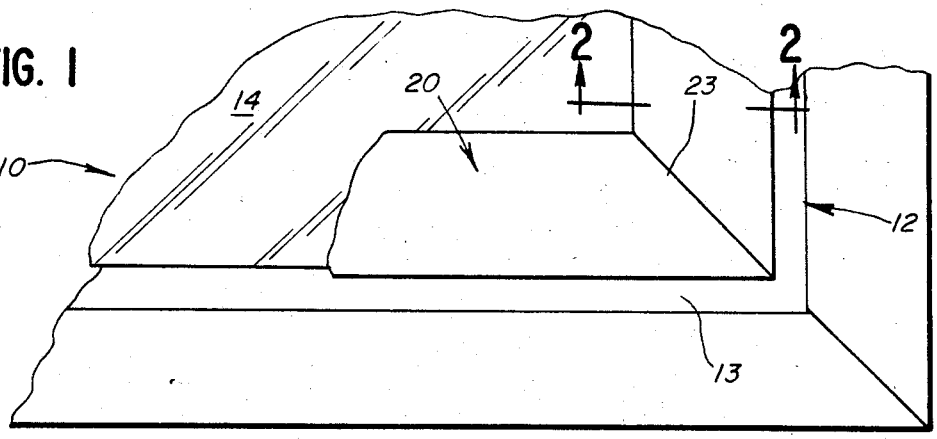
FIG. 1 is a fragmentary elevational view of a storm window suitable for installation and illustrating the magnet support and retainer constructed in accordance with the invention as installed thereupon.

In FIG. 1, an interior storm window 10 is illustrated mounted over the interior face of a preinstalled window assembly 12 mounted magnetically on the ferromagnetic surface of strips 13 secured to the underlying window sash. The magnet support and retainer 20 according to the invention is shown installed on the pane 14 formed of a generally uniformly thick rectangular sheet of light transmitting material such as glass, acrylic plastic or the like having top, bottom and opposite sides. The magnet bodies 22 seated in the support and retainer 20 are of generally rectangular configuration including inner and outer faces 16 and 18 and opposite ends 23 which may be mitered to abut with like ends when installed to define right angle corners. The outer faces 18 are generally planar (flat) to effect a good magnetic purchase upon the ferromagnetic surface on which they are engaged for installation.

Figure 2:
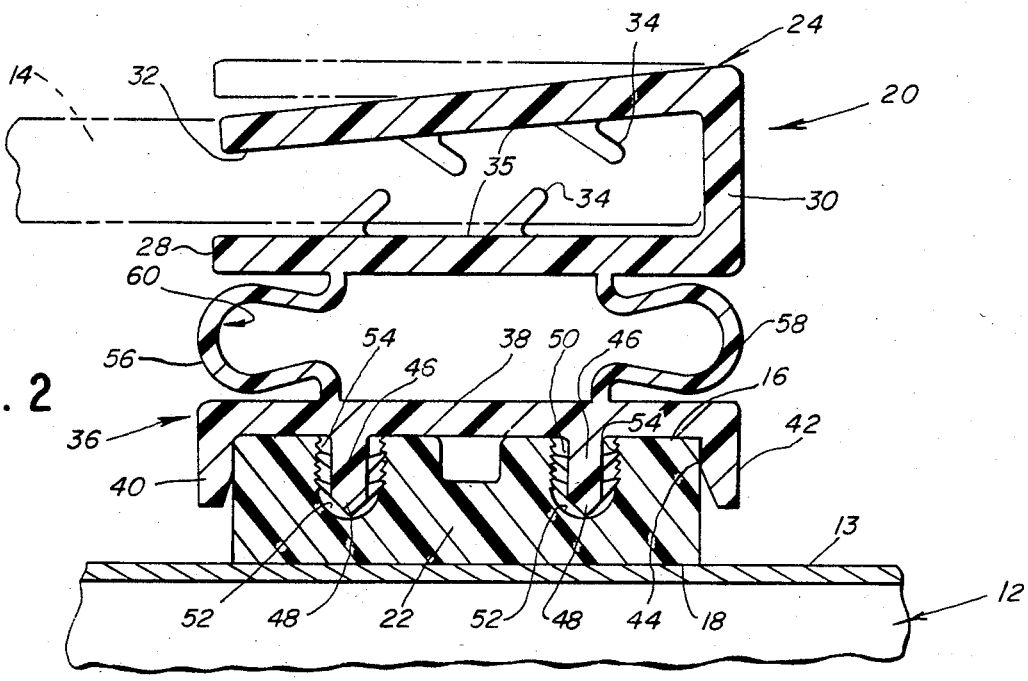
FIG. 2 is an enlarged section taken along lines 2—2 of FIG. 1 and viewed in the direction indicated.

Referring to FIG. 2, the magnetic support and retainer 20 is formed of a rigid pane receiving portion 24 defined by a pair of generally planar legs 26 and 28 joined along one edge thereof by bridging portion 30 to define opposite side entrance 32. The legs 26 and 28 taper one toward the other from the bridging portion 30 so that the opening 32 is narrowed. A plurality of angular resilient fingers 34 are provided on the interior facing surfaces 35 of legs 26 and 28. The fingers 34 are formed simultaneously with the formation of the unitary magnet support and retainer 20 but employing a lesser durometer material, usually by varying the quantity of plasticizer in the extrudate portion used to form said fingers. The fingers 34 function resiliently to grip the surface of the pane when same is forced between the legs 26 and 28.

The magnet retainer portion 36 is formed as a rigid planar strip 38 having a pair of depending flanges 40 and 42 along the opposite edges thereof and coextensive therewith. Portion 36 is formed simultaneously as a unit with the pane-receiving portion 24. The depending flanges 40 and 42 define together a cavity 44 having an interior width conforming to the width of the magnet body 22 whereby the latter can be force-fitted within the cavity. The strip 38 also is formed with intermediate depending tongues 46 extending longitudinally between the flange pair 40,42 and parallel thereto to extend into the cavity 44. The tongues 46 each have an enlarged head 48 in the configuration of an arrow or barb, with outwardly extending ribs 50 of flexible, lesser durometer being coextensive with the tongues 46 so as to define a barbed cross-sectional arrowlike configuration. The inner face 18 of the magnet body is formed with a pair of longitudinally extending grooves 52 opening thereto. When the magnet body 22 is force fitted into the cavity 44, the tongues 46 enter the grooves 52 with the barb-like ribs 50 frictionally engaged upon the walls defining each groove 52. Teeth formations 54 may be provided in each groove defining walls which cooperate with the ribs 50 for retaining the tongues 46. Each groove 52 may have a narrowed entrance to assure against inadvertent release of the tongue therefrom. The dimensions of each groove 52 are selected to enable limited movement of the tongue 46 within the groove so that a degree of resilience is afforded. This permits some adjustment for compensation for irregularities which may be encountered in the thickness of the pane or the surface of the ferromagnetic surface with which the outer face 18 of the installed magnet body is engaged.

Further resilience, i.e., give . . . is afforded by forming the connecting portions, i.e. walls 56 and 58 of flexible, resilient material of lesser durometer than the rigid portions of the magnet support and retainer 20. Walls 56 and 58 together define a bellows-like connecting formation including a hollow pocket 60, again to provide further compensation for the aforementioned irregularities.

Figure 3:
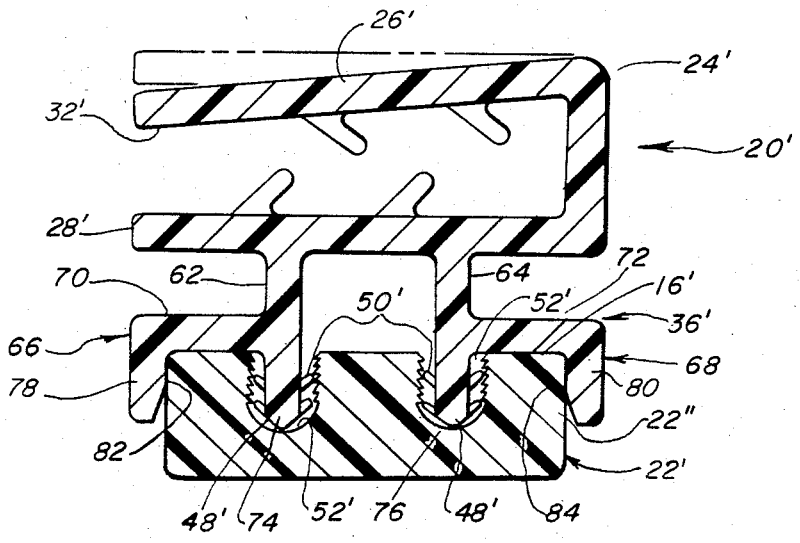
FIG. 3 is a view similar to that of FIG. 2 but illustrating a modified embodiment of the invention.

Referring to FIG. 3, a modified embodiment of the invention is illustrated as represented by support and retainer 20'. The pane-receiving portion is represented by the reference character 24' which differs from portion 24 of retainer 20 in that only leg 26′ is canted toward leg 28′ to narrow entrance 32′.

Retainer 20′ differs also from retainer 20 in the elimination of the flexible connecting walls 56,58 joining the magnet mounting portion 36′ to pane-receiving portion 24′ by a pair of rigid depending parallel flanges 62,64 having a pair of right angle formations 66 and 68 coextensive therewith, the legs 70 and 72 extending outward of said respective flanges 62 and 64 at locations spaced from the free ends 74,76 respectively thereof and coplanar one with the other and parallel to the leg 28 of the pane-receiving portion 24′ of retainer 20′. The legs 78 and 80 respectively depend from legs 70 and 72 and are parallel one to the other, defining cavities 82 and 84. The free ends 74 and 76 of flanges 62,64 are provided with enlarged formations 48′ and ribs 50′ making them substantially identical to the tongues 46 formed on retainer 20. The magnet body 22′ is provided with a pair of coextensive groove formations 52′ identical to groove formations 52 and opening to the inner face 16′ of magnet body 22′. The tongue formations 46′ are received within the groove formations 52′ when the magnet body 22′, that is the portions 22″ thereof, are respectively force-fitted into cavities 82 and 84 respectively. The principal functional difference between retainers 20 and 20′ is the elimination of the bellows formation defined by flexible walls 56 and 58 of retainer 20.

The flat outer surface of the magnet strip cooperates with the ferromagnetic surface of the window sash or the ferromagnetic strips which may be secured to the nonmagnetic window sash. The resilience afforded by the magnetic retaining and mounting structure of the invention compensates for any unevenness in the strip surface or likewise, enabling compensation for any variations in the plane surface, eigher in its planarity or surface irregularities. The entire installed storm window with the magnet retaining members installed therein is provided with some degree of "give" during installation and offers some resistance to displacement due to unusual weather conditions and moisture condensation.

Thus it is evident that the construction of the magnet support and retainer according to the invention establishes a limited floating relationship between the pane and its carrier and the magnet and its carrier assuming a sealing framing engagement between the magnet and its cooperating ferromagnetic surface, in turn affording a sealed mounting for the storm windowpane and the installed window construction. The ease of assembly further enhances the reduced cost achieved. It should be understood that although primarily intended to function as a support means for a storm window, the support and retainer means of the invention can be employed to function as support for effecting sealed relationship for doors, such as refrigerator doors, or other similar utilitarian objects. Changes may be made in detail such as shape, size and arrangement of parts, within the scope of the invention as claimed hereinafter.

It should be understood that the dimensions of cavities 44, 82 and 84 have been exaggerated (enlarged) for illustration to show detail, the relationship of said cavities to the magnets being such as to require force fitting of the magnets in the respective cavities.

What I claim is:

1. In combination, a pane of light transmitting sheet material and a magnet support and retainer therefor for accommodating a magnet body and enabling magnetic support of said pane over a post construction window installation to provide a substantially sealed dead air space therebetween, said magnet support and retainer comprising, rigid pane-receiving means, rigid magnet-receiving means and connecting means therebetween, said pane-receiving means formed as a U-shaped member having a side entrance for receiving the pane tightly therethrough, said magnet-receiving means including cavity-defining means for tightly accommodating a magnet body and cooperable resilient means formed in said cavity and said magnet body comprising tongue and groove means provided on said retainer and said magnet body respectively capable of being coupled together for resiliently mounting the magnet body within said cavity whereby to compensate for variations in the pane and in the surface adherent to said magnet body said tongue means includes resilient outwardly extending ribs unitary therewith, the cross-section of said tongue means being formed in the configuration of a barbed arrowhead, at least some portions thereof being formed of lesser durometer material than the material forming said pane-receiving and magnet-receiving portions.

2. The combination as claimed in claim 1 in which the connecting means comprise a pair of flexible, coextensive walls unitary with said pane-receiving means and said magnet-receiving means.

3. The combination as claimed in claim 1 in which the tongue means comprise a pair of tongues depending from said pane-receiving means coextensive therewith, each tongue having an enlarged free end and said groove means comprise longitudinal grooves formed in the magnet body, one for each tongue.

4. The combination as claimed in claim 1 in which said groove means include teeth formed in the inner walls defining same and adapted to engage said tongue means.

5. The combination as claimed in claim 1 in which each groove has teeth formed in the inner walls defining same and each tongue has resilient barbs engageable therewith.

6. The combination as claimed in claim 1 wherein the grooves have teeth and the ribs are engaged with said teeth.

7. The combination as claimed in claim 1 in which the connecting portions are formed of rigid depending parallel connecting walls, a pair of right angle formations unitary with the connecting walls and arranged to define a pair of longitudinally extending cavities, said magnet body including longitudinal portions force-fitted within said cavities, said connecting walls having free ends and said free ends forming said tongue means and being accommodated within said groove means said groove means capable of accomodating said tongue means when said longitudinal portions are engaged within said cavities.

8. In a post-construction storm window installation wherein a substantially planar pane of rigid light transmissive sheet material is applied over a window sheet frame and carries magnet means for adherence to a facing ferromagnetic surface carried by the window frame and a unitary magnet support and retainer member is provided for mounting a magnet body of the pane to present a planar face to the ferromagnetic surface, said magnet support and retainer having a rigid pane-retaining portion and a rigid magnet-retaining portion and connecting portions therebetween, the pane-retaining portion formed as a U-shaped member having a narrowed side entrance for edgewise reception of the pane, and the magnet body having inner and outer faces; the improvement comprising, said magnet support and retainer formed as a unitary elongate planar strip having depending rigid flange means defining a cavity of size and configuration conforming to the magnet body whereby to accommodate same in force-fitted relationship, said planar strip having depending tongue means including resilient barb means having at least end portions of lesser durometer and the inner face of the magnet body having longitudinal groove means formed in the inner face thereof, said tongue means resiliently engaged within said groove means when the magnet body is received within said cavity.

9. The structure as claimed in claim 8 in which the connecting portions comprise rigid depending parallel flanges unitary with said pane-receiving portion and said magnet-retaining portion comprises right angle flange formations unitary with said flanges, said flanges defining said tongue means at said free ends, said flanges cooperating with said right angle flanges to define said cavity, said tongue means having said barb means formed thereon.

10. The structure as defined in claim 8 in which said connecting portions are flexible.

11. A combined support and retainer for a magnet body and a generally rigid sheet material comprising first and second rigid support portions, and unitary connecting portions therebetween, said first portion including a side opening slot for securely accommodating edgewise a rigid sheet material, said second portion having outwardly opening cavity defining means for retaining a magnet body, a magnet body having inner and outer generally parallel faces, said second portion further having longitudinally extending depending tongue means, and longitudinal groove means formed in the inner face of said magnet body capable of receiving said tongue means therein when said magnet body is received with said cavity, the cavity being of size and configuration for retaining said magnet body force-fitted therein, said tongue means including outwardly extending barb means having tips of lesser durometer whereby to permit limited resilience between the magnet body and the retainer to afford compensation for variations in the surfaces to which the magnet body is adhered whereby to preserve the engagement of the magnet thereto.

12. The structure as claimed in claim 11 in which the connecting portions are rigid.

* * * * *